US005993103A

United States Patent [19]

Christensen

[11] Patent Number: 5,993,103

[45] Date of Patent: Nov. 30, 1999

[54] CONTROL BARRIER WITH SUPPORT LEGS

[75] Inventor: Marc E. Christensen, Salt Lake City, Utah

[73] Assignee: Off the Wall Products LLC, Salt Lake City, Utah

[21] Appl. No.: 08/841,467

[22] Filed: Apr. 22, 1997

Related U.S. Application Data

[63] Continuation-in-part of application No. 08/661,445, Jun. 6, 1996, Pat. No. 5,836,714, which is a continuation-in-part of application No. 08/533,738, Sep. 26, 1995, Pat. No. 5,611,641, which is a continuation-in-part of application No. 08/278,495, Jul. 20, 1994, Pat. No. 5,452,963.

[51] Int. Cl.[6] ..... E01F 13/02

[52] U.S. Cl. ..... 404/6; 404/9; 40/610; 40/612; 116/63 P; 256/64

[58] Field of Search ..... 404/6, 7, 9, 10; 256/1, 13.1, 26, 31, DIG. 6, 64; 49/9; 116/63 P, 63 T; 40/747, 748, 606, 610, 612, 755, 455, 605, 765; 248/174

[56] References Cited

U.S. PATENT DOCUMENTS

| | | | |
|---|---|---|---|
| D. 349,738 | 8/1994 | Naegele, III et al. . | |
| 1,049,261 | 12/1912 | Pelissier . | |
| 2,161,193 | 1/1939 | Freedman | 40/755 X |
| 2,788,596 | 4/1957 | Schwartz | 40/755 X |
| 2,794,375 | 6/1957 | DiFalco et al. . | |
| 2,893,148 | 7/1959 | Figman . | |
| 2,960,055 | 11/1960 | Tomek . | |
| 3,090,976 | 5/1963 | Liu . | |
| 3,141,655 | 7/1964 | Platt . | |
| 3,284,122 | 11/1966 | Rich . | |
| 3,503,600 | 3/1970 | Rich . | |
| 3,540,699 | 11/1970 | Guzzardella . | |
| 3,572,465 | 3/1971 | Olson . | |
| 3,661,359 | 5/1972 | Walker . | |
| 3,672,657 | 6/1972 | Young et al. . | |
| 3,822,954 | 7/1974 | Ansgariusson . | |
| 3,856,268 | 12/1974 | Fitch . | |
| 3,880,406 | 4/1975 | Stehle et al. | 256/64 |
| 4,138,095 | 2/1979 | Humphrey . | |
| 4,279,105 | 7/1981 | Cameron | 52/71 |
| 4,298,186 | 11/1981 | Glass . | |
| 4,348,133 | 9/1982 | Trent et al. . | |
| 4,380,327 | 4/1983 | Fish . | |
| 4,423,854 | 1/1984 | Cobb et al. . | |
| 4,435,106 | 3/1984 | Förster et al. . | |
| 4,500,225 | 2/1985 | Quittner . | |
| 4,624,210 | 11/1986 | Glass . | |
| 4,665,673 | 5/1987 | Diana . | |
| 4,681,302 | 7/1987 | Thompson . | |
| 4,773,629 | 9/1988 | Yodock . | |
| 4,796,369 | 1/1989 | Hamann . | |
| 4,854,767 | 8/1989 | Sasaki . | |
| 4,869,617 | 9/1989 | Chiodo . | |
| 4,925,333 | 5/1990 | Bishop . | |
| 4,943,035 | 7/1990 | Thomson et al. . | |
| 4,944,060 | 7/1990 | Peery et al. . | |
| 4,946,306 | 8/1990 | Yodock . | |

(List continued on next page.)

FOREIGN PATENT DOCUMENTS

| | | |
|---|---|---|
| 50241/93 | 8/1994 | Australia . |
| 0 442 249 A1 | 8/1991 | European Pat. Off. . |
| 2 619 400 | 2/1989 | France . |
| 2660 945 A1 | 4/1990 | France . |
| 2 663 657 | 12/1991 | France . |
| 2 743 825 | 7/1997 | France . |

(List continued on next page.)

*Primary Examiner*—James A. Lisehora
*Attorney, Agent, or Firm*—Workman, Nydegger & Seeley

[57] ABSTRACT

A control barrier is provided having a barrier wall with one or two support legs attached thereto. The barrier wall has a front face with a display recess formed therein and an internal cavity for selective filling with a ballast material. Each of the support legs are hingedly mounted to the back face of the barrier wall so as to selectively fold flat. Each support leg has an interior surface defining an internal chamber for selective filling with a ballast material.

21 Claims, 5 Drawing Sheets

U.S. PATENT DOCUMENTS

| | | | |
|---|---|---|---|
| 4,974,815 | 12/1990 | Glass | 256/64 |
| 4,978,245 | 12/1990 | White | 404/6 |
| 5,009,541 | 4/1991 | Thurston | 404/6 |
| 5,011,325 | 4/1991 | Antonioli | 404/6 |
| 5,106,554 | 4/1992 | Drews . | |
| 5,122,008 | 6/1992 | Drews . | |
| 5,123,773 | 6/1992 | Yodock . | |
| 5,208,585 | 5/1993 | Sprague . | |
| 5,213,312 | 5/1993 | MacDonald . | |
| 5,269,623 | 12/1993 | Hanson . | |
| 5,387,049 | 2/1995 | Duckett . | |
| 5,412,381 | 5/1995 | Dicks . | |
| 5,452,963 | 9/1995 | Christensen | 404/6 |
| 5,460,353 | 10/1995 | Rittenhouse . | |
| 5,467,548 | 11/1995 | Ross . | |
| 5,498,101 | 3/1996 | Braverman | 404/6 |
| 5,586,594 | 12/1996 | Shapoff | 160/135 |
| 5,611,641 | 3/1997 | Christensen | 404/6 |
| 5,634,225 | 6/1997 | Miller, Sr. et al. . | |
| 5,639,179 | 6/1997 | Jensen . | |
| 5,772,357 | 6/1998 | Evans | 404/7 |
| 5,775,919 | 7/1998 | Gardner | 434/408 |
| 5,836,714 | 11/1998 | Christensen | 404/6 |

FOREIGN PATENT DOCUMENTS

| | | | |
|---|---|---|---|
| 1658470 | 12/1970 | Germany . | |
| 3-125708 | 5/1991 | Japan | 404/6 |
| 942255 | 11/1963 | United Kingdom . | |
| 1 482 634 | 8/1977 | United Kingdom . | |
| 2 084 635 | 4/1982 | United Kingdom . | |
| 2 219 332 | 12/1989 | United Kingdom . | |
| 2 237 832 | 5/1991 | United Kingdom . | |
| 2240801 | 8/1991 | United Kingdom | 404/6 |
| 2 282 836 | 4/1996 | United Kingdom . | |

CONTROL BARRIER WITH SUPPORT LEGS

RELATED APPLICATIONS

This application is a continuation-in-part of U.S. patent application Ser. No. 08/661,445 filed Jun. 6, 1996 for "CONTROL BARRIER SYSTEMS" by Mark E. Christensen, U.S. Pat. No. 5,836,714 which is a Continuation-in-Part of U.S. patent application Ser. No. 08/533,738 filed Sep. 26, 1995 for "IMPROVED CROWD CONTROL BARRIER SYSTEM" by Marc E. Christensen, U.S. Pat. No. 5,611,641, which is a continuation-in-part of U.S. application Ser. No. 08/278,495 filed Jul. 20, 1994 now U.S. Pat. No. 5,452,963, entitled "CROWD CONTROL BARRIER," which issued Sep. 26, 1995 in the name of Marc E. Christensen. For the purpose of disclosure for the present application, the above identified references are incorporated herein by specific reference.

BACKGROUND OF THE INVENTION

1. The Field of the Invention

The present invention relates to portable, reusable control barriers, and more specifically, reusable control barriers having collapsible support legs.

2. The Relevant Technology

Control barriers are used in a variety of situations. For example, control barriers can be selectively positioned at special events, such as parades, to help direct crowds in a desired direction. Alternatively, control barriers can be put up to help limit access to select areas. In yet other embodiments, control barriers can be used to define an area such as an entertainment stage or the course for a sporting event.

Conventional control barriers have long comprised individual sawhorse type barriers and collapsible V-shape barricades. Such barriers, however, are generally lightweight and are easily tipped over. As a result, conventional control barriers have limited use in situations where crowds may be pushing against the barriers or where it is likely that the barriers may be impacted. In addition, such barriers are typically made of non-flexible metals or wood and have sharp corners. Accordingly, such structures pose a potential risk to crowds, athletes, or the like who may be pushed or otherwise come in contact with the barriers. Furthermore, such barriers are typically not connected and often have spaces or gaps extending therethrough. As such, it is possible for individuals to either slip between or through the barriers.

Other barriers comprise various gate or wall configurations. Such barriers, however, require extensive time to assemble and disassemble. In yet other alternative embodiments, concrete barriers have been used. Although concrete barriers are not easily tipped over, such barriers are extremely heavy. As such, they are difficult to move and place in a desired location. Often, special equipment such as fork lifts or cranes are required. Furthermore, concrete barriers require a large storage area, are difficult and expensive to move over large distances, and are difficult to dispose of once they are damaged or begin to fail. Finally, concrete barriers can be dangerous in that they are rigid and non-forgiving when impacted by a person or object.

SUMMARY AND OBJECTS OF THE INVENTION

Accordingly, it is an object of the present invention to provide improved control barriers which are relatively light weight for ease in transporting, storing, and positioning.

Another object of the present invention is to provide improved control barriers that can be selectively ballasted after being positioned to increase their stability.

It is a further object of the present invention to provide control barriers which may be easily unballasted and reused.

Yet another object of the present invention is to provide control barriers that are easily recycled into new barriers.

It is another object of the present invention to provide control barriers that can be easily positioned into a desired configuration and selectively interconnected.

Also, another object of the present invention is to provide control barriers that are absent of sharp comers and which will yield slightly upon impact to lessen the damage to an object or individual colliding with the barrier.

Finally, another object of the present invention is to provide improved control barriers that can be partially collapsed for ease in stacking and storage.

To achieve the forgoing objectives, the present invention provides a collapsible barrier including a barrier wall having a front face and an opposing back face. Two legs are hingedly mounted to the back face and are designed to fold flat thereagainst. As a result, the collapsed barrier has a substantially boxed shaped configuration which is easy for transporting, stacking, and storing. Both the barrier wall and each of the support legs has an interior surface which defines a distinct internal chamber. Each internal chamber can be selectively filled with a ballast, such as water or sand, for holding the barrier in a stationary position. Once an intended use of the barrier is completed, the ballast can be drained from the corresponding internal chamber. By selectively adding or removing ballast, the control barrier can be used in a variety of different situations and yet still be easily picked up and moved.

Positioned on the front face of the barrier is a display recess. Engagement fingers project from opposing sides of the display recess to enable a flexible display to be positioned and securely held within the recess. The barrier wall also has opposing sidewalls. Projecting from one sidewall is an engagement foot. Recessed within the opposing sidewall is a capture slot. The capture slot is configured to receive the engagement foot from an adjacent barrier. As a result, a plurality of barriers can be adjacently disposed and connected for forming a relatively solid wall.

In an alternative embodiment, a collapsible barrier can be formed using a single support leg. The support leg can be hingedly attached at one of the opposing ends of the barrier wall or centrally located on the back surface of the barrier wall. The present invention further includes means for securing the single support leg in the open position.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
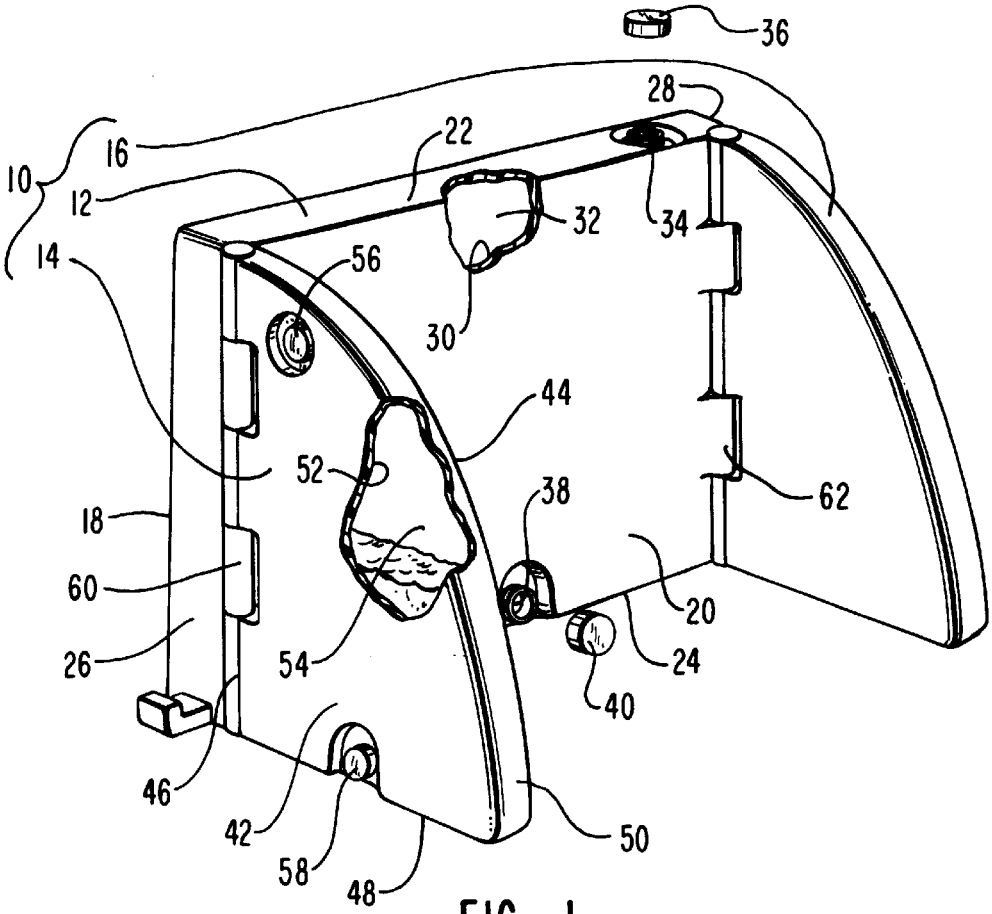
FIG. 1 is a perspective rear view of one embodiment of a control barrier of the present invention having a pair of collapsible support legs.

Depicted in FIG. 1 is one embodiment of a control barrier 10 incorporating features of the present invention. Control barrier 10 comprises a barrier wall 12 with a first support leg 14 and an opposing second support leg 16 attached thereto. Barrier wall 12 has a thin, substantially box shaped configuration including a front face 18 with an opposing back face 20, a top surface 22 with an opposing bottom surface 24, and a first sidewall 26 with an opposing second sidewall 28. Although front face 18 and back face 20 are shown as being substantially parallel to each other, each of these faces can also be selectively slopped at a desired angle. Barrier wall 12 further includes an interior surface 30 defining an internal chamber 32.

In one embodiment of the present invention, means are provided for selectively filing internal chamber 32 with a ballast. By way of example not by limitation, a recessed fill hole 34 is formed on top surface 22 of barrier wall 12 so as to communicate with internal chamber 32. A cap 36 is configured to selectively seal off fill hole 34. A ballast material, such as water, sand, or other fluid like material, can thus be selectively positioned within internal chamber 32 by way of fill hole 34. The ballast weights barrier wall 12 so as to increase stability.

The present invention also includes means for selectively draining the ballast from internal chamber 32. By way of example, a recessed drain hole 38 is formed on back face 20 adjacent to bottom surface 24 of barrier wall 12. A cap 40 is configured to selectively close off drain hole 38. Drain hole 38 can thus be used to remove ballast from within internal chamber 32. With the ballast removed from barrier wall 12, control barrier 10 is relatively light, thereby enabling control barrier 10 to be easily picked up for transportation and stacked for storing.

First support leg 14 has an outside face 42 and an opposing inside face 44. First support leg 14 also has a substantially triangular perimeter defined by an upstanding attachment edge 46, a bottom edge 48, and a curved outside edge 50 that extends from the remote end of bottom edge 48 to the top of attachment edge 46. First support leg 14 also includes an interior surface 52 that defines an internal chamber 54. Means are provided for selectively filling internal chamber 54 with a ballast. By way of example not by limitation, a cap 56 selectively covers a recessed fill hole located near the top of outside face 42. In alternative embodiments, the fill hole and corresponding cap 56 can be located on inside face 44 or on outside edge 50.

Means are also provided for selectively draining the ballast from internal chamber 54. By way of example not by limitation, a cap 58 selectively covers a recessed drain hole located on outside face 42 adjacent to bottom surface 48. In alternative embodiments, cap 58 can likewise be positioned on inside face 44 or outside edge 50. The fill hole and drain hole on support leg 14 operate in the same manner as the corresponding structure on barrier wall 12. Adding ballast to support leg 12 further supports control barrier 10 in an upstanding position.

Figure 2:
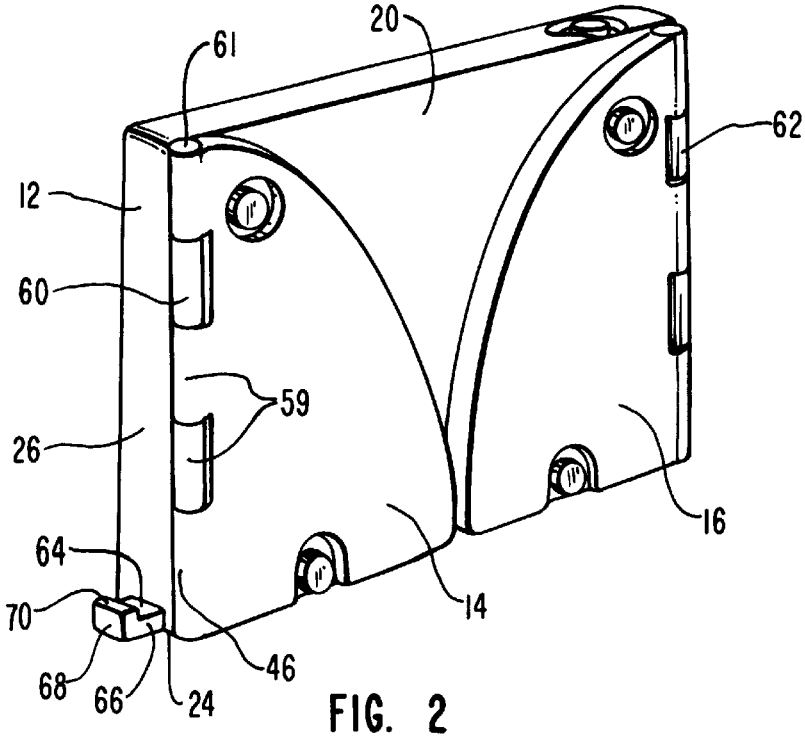
FIG. 2 is a perspective view of control barrier shown in FIG. 1 with the support legs folded.

The present invention also includes means for hingedly attaching first support leg 14 to barrier wall 12. By way of example not by limitation, a hinge 60 is formed between attachment edge 46 of first support leg 14 and back face 20 along first sidewall 26 of barrier wall 12. Hinge 60 enables first support leg 14 to rotate between an open position as depicted in FIG. 1 and a retracted or closed position as depicted in FIG. 2. In the open position, first support leg is oriented so as to be substantially perpendicular to back face 20 of barrier wall 12. In the closed position, inside face 44 of first support leg 14 is biased flush against back face 20 of barrier wall 12. There are of course a variety of alternative hinge structures which can be used. For example, as depicted in FIG. 1, hinge 60 comprises a plurality of interlocking hinge members 59 that are integrally molded with barrier wall 12 and first support leg 14. A pin 61 extends through interlocking hinge members 59 and provides an axis about which support let 14 rotates. In alternative embodiments, opposing sides of a discreet hinge can be attached to the first support leg 14 and barrier wall 12. Furthermore, a living hinge can be used.

Second support leg 16 has substantially the same configuration and performs substantially the same function as first support leg 14. Second support leg 16, however, is attached to back face 20 of barrier wall 12 along second sidewall 28. For ease of reference, like structural elements between first support leg 14 and second support leg 16 are identified herein by like reference characters.

The present invention also includes means for hingedly attaching second support leg 16 to barrier wall 12. By way of example not by limitation, a hinge 62 is formed between attachment edge 46 of second support leg 16 and back face 20. Alternative embodiments for hinge 62 are the same as those discussed with regard to hinge 60. As depicted in FIG. 2, hinges 60 and 62 enable first support leg 14 and second support leg 16 to each fold into a retracted position so that inside faces 42 are biased against back face 20 of barrier wall 12. As a result, collapsed control barrier 10 has a substantially boxed shaped configuration that enables control barrier 10 to be easily stacked and stored.

Barrier wall 12 and each support leg 14 and 16 is discretely made, preferably by a rotational molding process. Alternatively, other molding processes, such as injection molding, can also be used to manufacture the parts. Furthermore, each barrier 12 and support leg 14 and 16 is preferably made of a resiliently deformable plastic material having strong, semi-rigid and energy absorbing properties. Such materials include linear or cross link plastics, preferably polyethylene. The materials are selected from a polymeric group which will deform under internal pressure but will not fail in a brittle manner. The materials are also selected to enable old or broken barriers to be ground down and recycled into new barriers.

Figure 3:
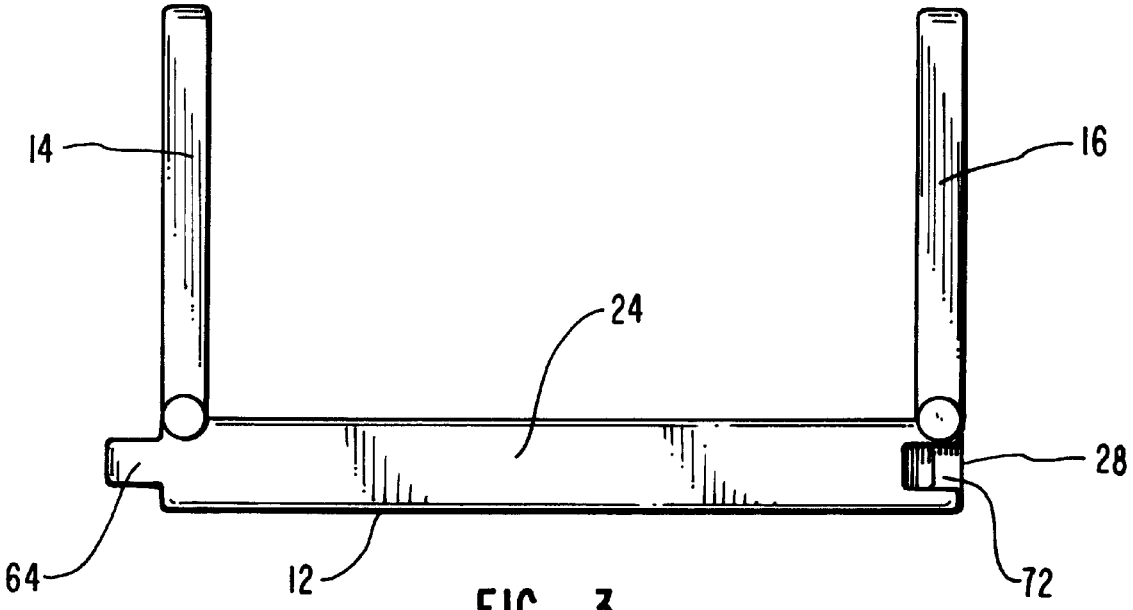
FIG. 3 is a bottom plan view of the control barrier shown in FIG. 1.

The present invention also includes means for interconnecting adjacent barriers. By way of example and not by limitation, an engagement foot 64, as depicted in FIG. 2, projects from first sidewall 26 adjacent to bottom surface 24 of barrier wall 12. Engagement foot 64 includes a flat portion 66 which terminates at a free end 68 and a lip 70 upstanding from free end 68. As depicted in FIG. 3, a capture slot 72 is recessed within bottom surface 24 of barrier wall 12 and extends through second sidewall 28 thereat. Capture slot 72 is configured to complimentary receive engagement foot 64 of an adjacent control barrier. As a result, a plurality of control barriers can be positioned adjacent to each other and interconnected by inserting each engagement foot 64 into a corresponding capture slot 72. The security of engagement between engagement foot 64 and capture slot 72 increases as ballast is filled within barrier wall 12 first support leg 14 and second support leg 16.

Figure 4:
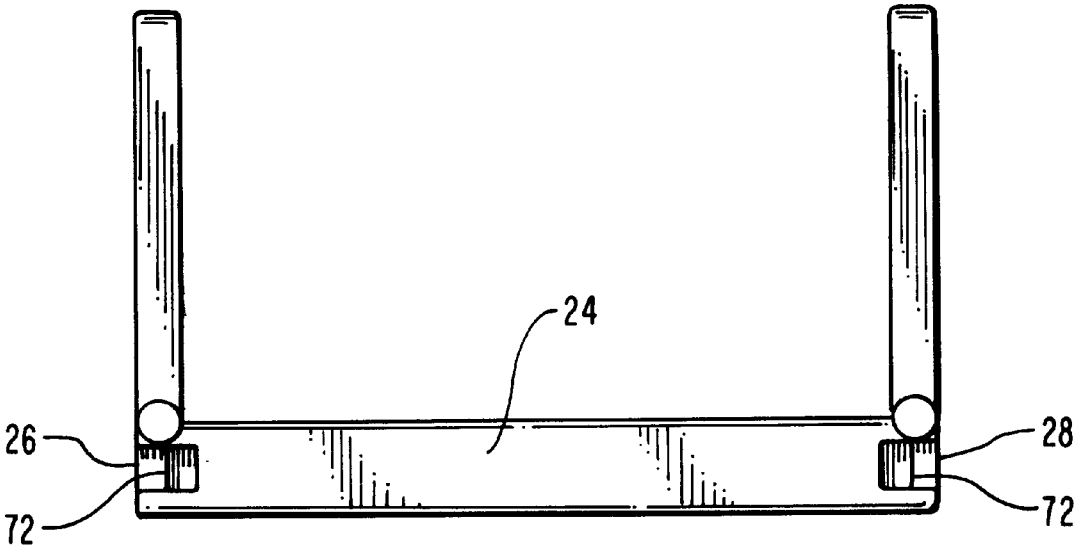
FIG. 4 is a bottom plan view of an alternative embodiment of a control barrier.
Figure 5:
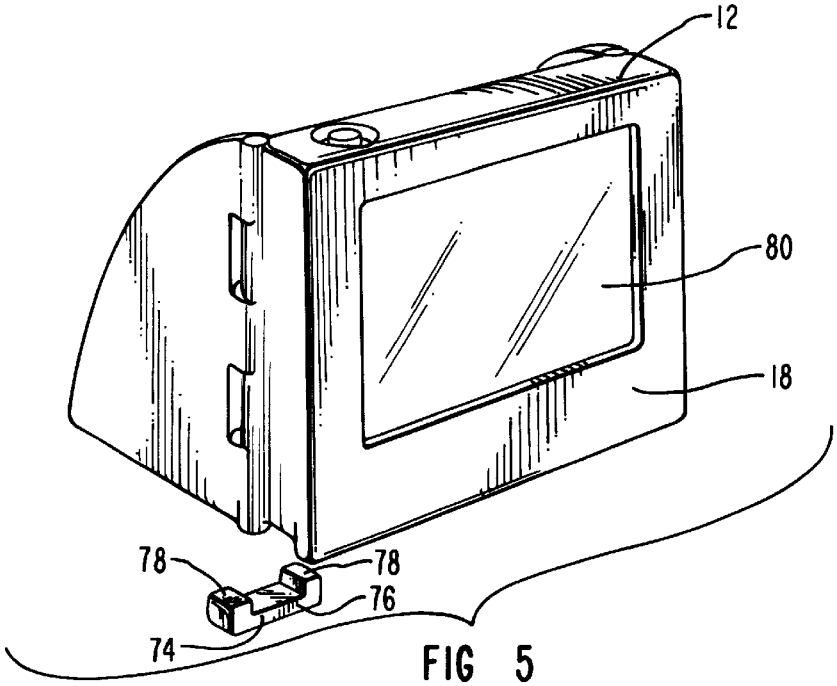
FIG. 5 is a perspective front view of the control barrier shown in FIG. 4.

In an alternative embodiment, as depicted in FIG. 4, a pair of complimentary capture slots 72 are recessed within bottom surface 24 so as to extend through both first sidewall 26 and second sidewall 28. In this configuration, as depicted in FIG. 5, a U-shaped engagement bracket 74 can be used for connecting adjacent barriers. Engagement bracket 74 includes a flat base 76 with vertical lips 78 upstanding from opposing ends thereof. Each lip 78 is received within a corresponding capture slot 72 of adjacent control barriers so as to connect the control barriers together.

Figure 6:
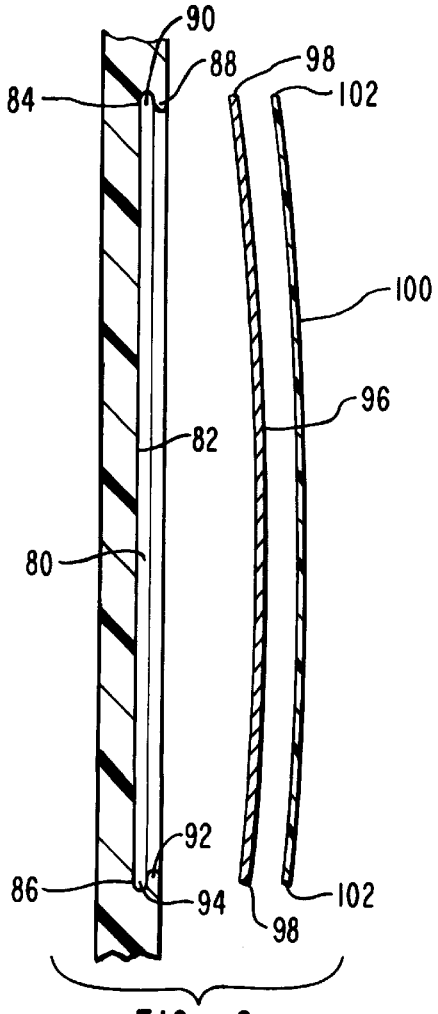
FIG. 6 is a cross-sectional side view of the barrier wall of the control barrier shown in FIG. 5 with a display detached therefrom.

The present invention also includes means for removably securing an advertising display substantially flush against front face 18 of barrier wall 12. By way of example not by limitation, depicted in FIG. 5 is a display recess 80 formed in front face 18. FIG. 6 discloses an enlarged cross-sectional view of display recess 80. As depicted therein, display recess 80 comprises a display face 82 extending between a top edge 84 and a bottom edge 86. Projecting from top edge 84 a distance towards bottom edge 86, is a first retention lip 88. Retention lip 88 extends so that a slot 90 is formed between first retention lip 88 and display face 82. In like manner, a second retention lip 92 projects from bottom edge 86 a distance towards top edge 84. Second retention lip 92 projects so as to define a slot 94 positioned between second retention lip 92 and face 82.

Figure 7:
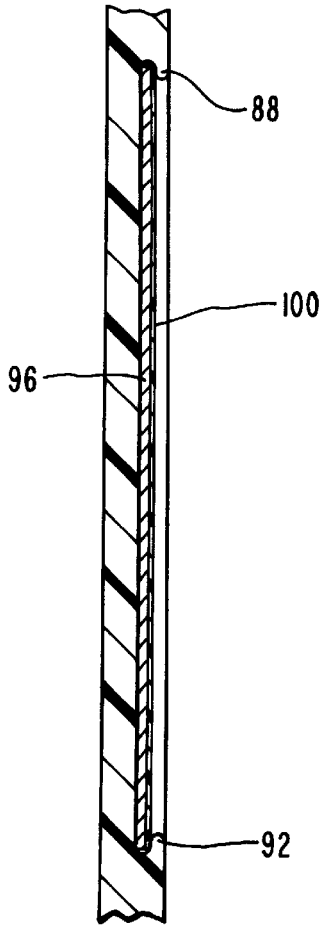
FIG. 7 is a cross-sectional side view of the barrier wall shown in FIG. 6 with the display attached thereto.

As also depicted in FIG. 6, a display 96 is shown. Display 96 is preferably made of paper or thin cardboard and is sized so that when bowed, opposing edge 98 of display 96 can be positioned flush against display face 82. As display 96 is unbowed, edges 98 are complimentarily received within slots 90 and 94, as shown in FIG. 7. In one embodiment, a cover 100 can be positioned over the top of display 96 for protecting and securely holding display 96 against display face 82. That is, display 96, when made from thin, flexible, paper, may be damaged by rain or be blown off barrier wall 12 by wind. Cover 100, preferably made of a clear polycarbonate having a thickness of about 1/16th of an inch and dimensioned comparable to display 96, can likewise be bowed so that opposing edges 102 can be received within slots 90 and 94. Cover 100 acts to protect display 96 from rain and, as a result of its increased structural integrity compared to paper, is better able to hold display 96 within display recess 80. To remove cover 100 and display 96, cover 100 is simply bowed so that opposing ends 102 are removed from slots 90 and 94. In an alternative embodiment, display 96 can be made of a flexible vinyl having a thickness of about 1/16th of an inch on which the advertising can be silk screened. In this embodiment it may not be necessary to use cover 100.

In alternative embodiments of the means for removably securing the advertising display, retention lips 88 and 92 can be positioned horizontally rather than vertically. That is, the retention lips can be positioned parallel to first sidewall 26 and second sidewall 28 of barrier wall 12. In yet other embodiments, one edge of cover 100 can be hingedly connected to barrier wall 12, while the opposing edge can be bowed to be received within a retention lip.

There are several benefits to using the above structure for attaching advertising display 96 to barrier wall 12. Most notably, by attaching display 12 flush against the surface of barrier wall 12, projecting corners and edges are eliminated. As such control barriers 10 can be used in sporting events and for directing crowds while minimizing the potential injury to an individual who may impact the barriers. Furthermore, the above structure provides easy attachment and removal of display 96 and provides for prominent disclosure of the advertising display.

Figure 8:
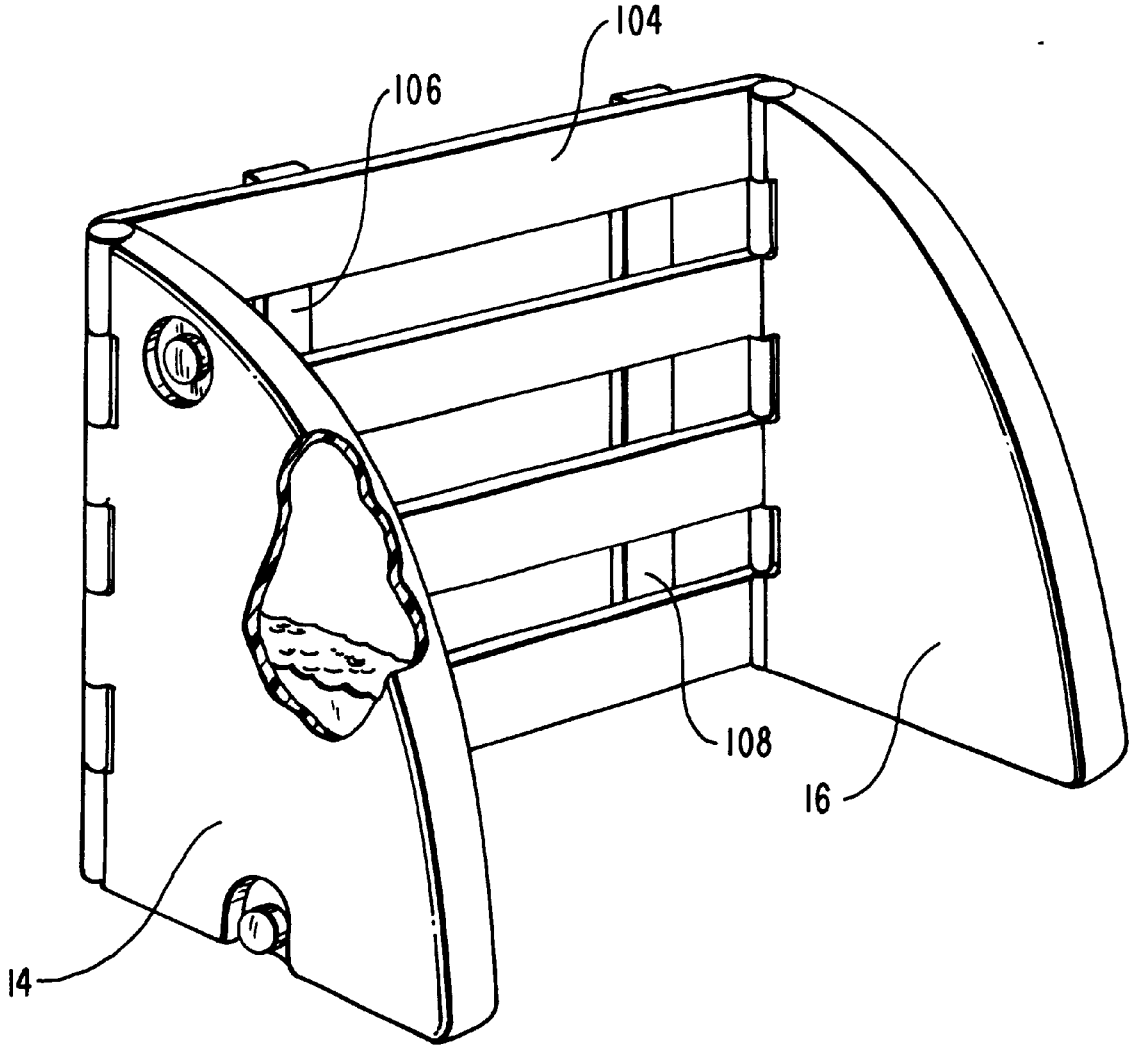
FIG. 8 is a perspective view of an alternate embodiment of a control barrier having a solid barrier wall.

In one embodiment of the present invention, first support leg 14 and second support leg 16 can be used independent of barrier wall 12. That is, as depicted in FIG. 8, first support leg 14 and second support leg 16 can be attached to a barrier wall 104 that does not contain an internal chamber for selective filling with the ballast. For example, barrier wall 104 comprises a plurality of slats 106 connected by vertical supports 108.

Figure 9:
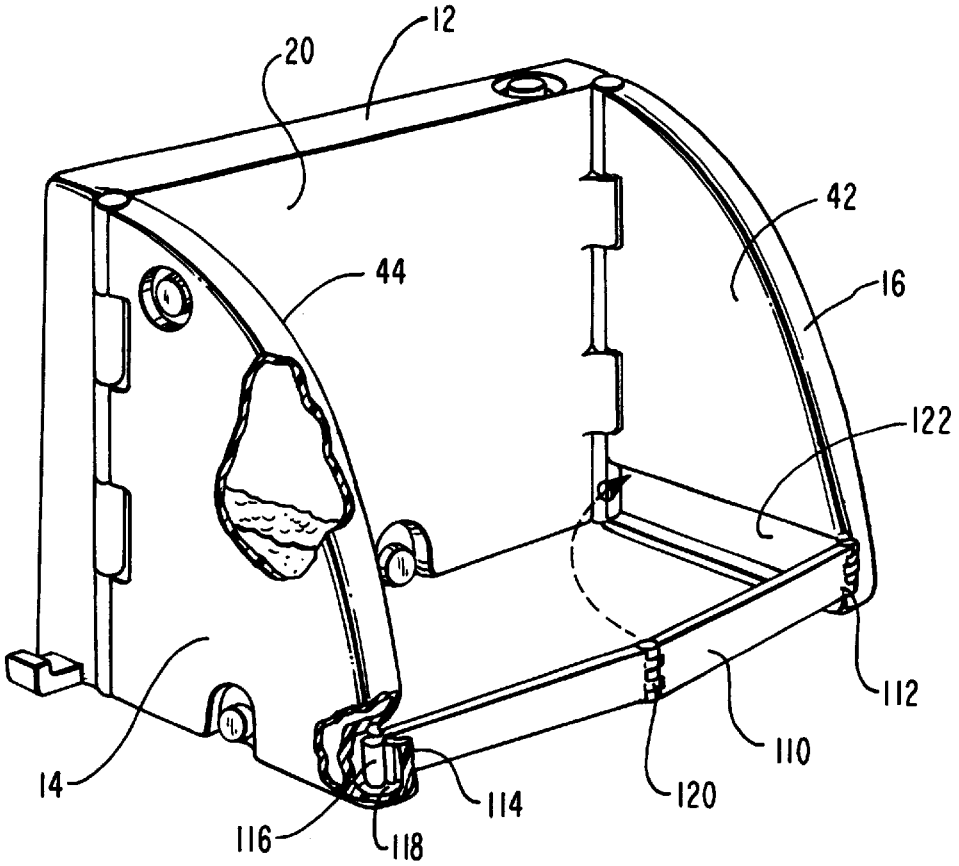
FIG. 9 is a perspective view of an alternative embodiment of a control barrier having a hinged brace.

In yet another alternative embodiment, means are provided for mechanically holding first support leg 14 and second support leg 16 in the open position. As depicted in FIG. 9, a brace 110 is provided. Brace 110 has a first end 112 hingedly attached to second support leg 16 and a second end 114 with an enlarged bulb 116 formed thereat. Bulb 116 selectively snaps into an expandable slot 118 formed within first support leg 14 on inside face 44. Centrally disposed along brace 110 is a hinge 120. Hinge 120 enables brace 110 to fold together and selectively be received within an elongated recess 122 formed on inside face 42 of second support leg 16. In this configuration, first support leg 14 and second support leg 16 can still be folded closed, as in FIG. 2, so as to be flush against back face 20 of barrier wall 12. In an alternative embodiment a discrete rigid brace could be used to selectively extend between first support leg 14 and second support leg 16.

Figure 10:
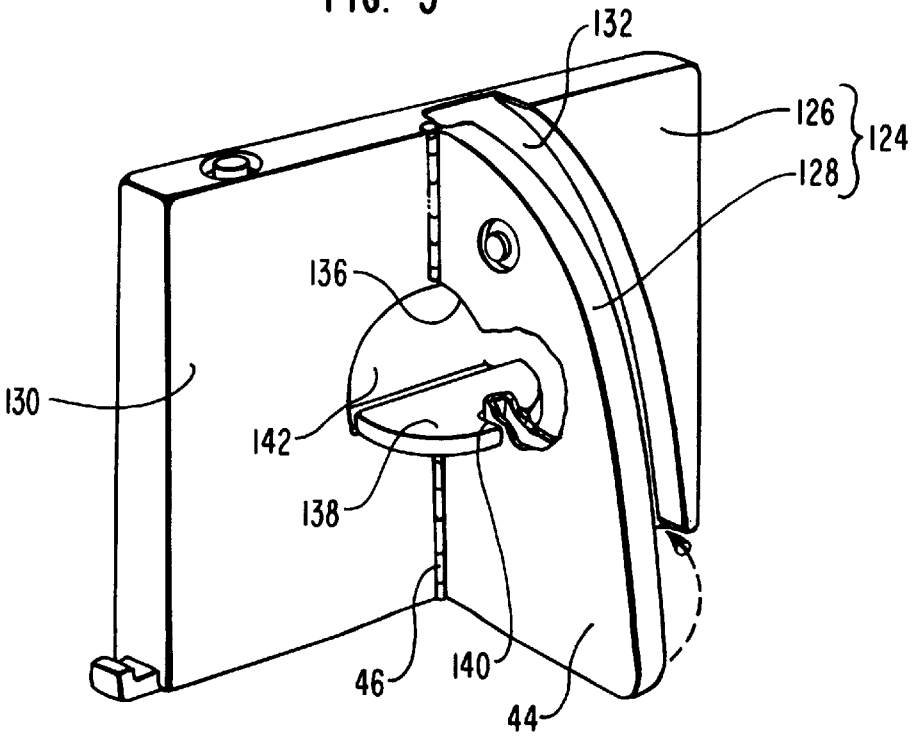
FIG. 10 is a perspective view of an alternative embodiment of a control barrier having a single support leg.

Control barrier 10 can also be designed having a single support leg. For example, depicted in FIG. 10 is a control barrier 124 comprising a barrier wall 126 and a support leg 128 attached thereto. Barrier wall 126 has a back face 130 with an enlarged recess 132 form therein. Support leg 128 is substantially similar to first support leg 14 with like elements being identified by like reference characters. Inside edge 46 of support leg 128 is hingedly attached to back face 130 adjacent to recess 132. In this configuration, support leg 128 can hingedly rotate into recess 132 so that outside face 44 of support leg 128 is substantially flush with back face 130 of barrier wall 126.

Means are also provided for securing support leg 128 in an open position. By way of example and not by limitation, an arcuate recess 136 is formed on inside edge 46 of support leg 128. A locking member 138 is hingedly mounted to back face 130 and has an engaging slot 140 formed thereon. Locking member 138 can be selectively moved between a closed position and a locking position. In the closed position, locking member 138 is folded into a complimentary recess 142 formed in back face 130 of barrier wall 126.

In this position, support leg 128 is free to rotate around its attached hinge. With support leg 128 in the open position, locking member 138 can be folded out of recess 142 so that engaging slot 140 captures support leg 128 adjacent to recess 136. In this position, as depicted in FIG. 10, support leg 128 is held in place.

There are, of course, a variety of alternative structures which can be used to secure support leg 128 in the open position. For example, support leg 128 can be hingedly attached towards one of the opposing sidewalls of barrier wall 126. The first end of an elongated brace can then be hingedly attached to back face 130 of barrier wall 126 while the opposing end can be selectively coupled to support leg 128 so as to rigidly hold support leg 128 in the open or at least partially open position.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A control barrier comprising:

(a) a control barrier wall having a bottom surface extending between a first end having a first sidewall formed thereat and an opposing second end having a second sidewall formed thereat;

(b) a first support leg hingedly secured to the barrier wall to support the barrier wall in an upstanding position, the first support leg being secured at the first end of the barrier wall;

(c) a second support leg secured at the second end of the barrier wall;

(d) means for connecting the barrier to an adjacent barrier comprising:

(i) a first capture slot recessed into the bottom surface of the control barrier wall and extending through the first sidewall thereof;

(ii) a second capture slot recessed into the bottom surface of the control barrier wall and extending through the second sidewall thereof; and (iii) a substantially U-shaped bracket comprising a flat portion and a lip upstanding from each opposing end thereof, each lip being configured to be received within a corresponding first capture slot and second capture slot when discrete control barriers are positioned adjacent to each other.

2. A control barrier as recited in claim 1, wherein the first support leg has an interior surface defining an internal chamber, the internal chamber communicating to the exterior through a fill hole.

3. A control barrier as recited in claim 1, wherein the barrier wall further comprises an interior surface defining an internal chamber, the internal chamber communicating with the exterior through a fill hole.

4. A control barrier comprising:

(a) a control barrier wall having a front face and a back face each extending between opposing ends;

(b) a pair of support legs, each of the support legs being hingedly attached to one of the corresponding ends of the barrier wall, each support leg also having an interior surface defining an internal chamber;

(c) means formed on each of the support legs for filling the internal chamber with a ballast; and (d) means for mechanically holding each of the support legs in an open position.

5. A control barrier as recited in claim 4, wherein the barrier wall further comprises an exterior surface enclosing an internal chamber, the internal chamber communicating with the exterior through a fill hole.

6. A control barrier as recited in claim 4, wherein each of the support legs are molded from a recyclable plastic.

7. A control barrier as recited in claim 4, wherein the barrier wall comprises a front face and means for removably attaching a display substantially flush against the front face.

8. A control barrier as recited in claim 7, wherein the means for removably attaching the display comprises a pair of opposing retention lips formed on the front face, each retention lip projecting to define a slot formed between the retention lip and the front face of the housing.

9. A control barrier as recited in claim 4, wherein each of the support legs are hingedly attached to the back face of the barrier wall at the opposing ends thereof.

10. A control barrier as recited in claim 4, wherein the means for mechanically holding each of the support legs in an open position comprises a brace that selectively extends between each of the legs.

11. A control barrier comprising:

(a) a control barrier wall including a bottom surface with first and second sidewalls upstanding at opposing ends thereof;

(b) a first support leg hingedly secured to the barrier wall to support the barrier wall in an upstanding position; and (c) means for connecting the barrier to an adjacent barrier, the means for connecting comprising:

(i) an engagement foot including a substantially flat portion projecting out from the first sidewall at the bottom surface and a lip upstanding from the free end of the flat portion; and (ii) a capture slot recessed into the bottom surface of the barrier wall and extending through the second sidewall thereof, the capture slot being configure to receive the engagement foot of an adjacent barrier.

12. A control barrier comprising:

(a) a control barrier wall having a front face and an opposing back face each extending between opposing ends; and (b) a pair of discrete spaced apart support legs rotatably mounted on the control barrier wall, the support legs being selectively movable between a retracted first position and an extended second position wherein at least a portion of each support leg projects from the back face of the control barrier wall so as to support the control barrier wall in an upstanding position, at least one of the support legs having an interior surface defining an internal chamber configured to receive a ballast, the at least one support leg being comprised of a resiliently deformable plastic material such that the at least one support leg is rigidly self-supporting when the internal chamber thereof is openly exposed to the exterior.

13. A control barrier as recited in claim 12, wherein at least one of the support legs is hingedly mounted to the back face of the control barrier wall.

14. A control barrier as recited in claim 12, wherein the control barrier wall has an interior surface defining an internal chamber configured to receive a ballast.

15. A control barrier as recited in claim 12, further comprising means for connecting the barrier to an adjacent barrier.

16. A control barrier as recited in claim 12, wherein the control barrier wall further comprises means for removably securing an advertising display substantially flush against the front face.

17. A control barrier comprising:

(a) a control barrier wall having a front face and an opposing back face each horizontally extending between opposing ends, the front face and back face bounding an internal chamber configured to receive a ballast, the internal chamber communicating with the exterior through a fill hole; and (b) a support leg having an inside edge hingedly mounted in a vertical orientation along the back face of the control barrier wall substantially centrally between the opposing ends thereof to selectively support the control barrier wall in an upstanding position, the support leg being selectively movable between an extended position and a retracted position.

18. A control barrier as recited in claim 17, wherein the support leg has an interior surface defining an internal chamber configured to receive a ballast.

19. A control barrier as recited in claim 17, further comprising a mechanical means for securing the support leg in the extended position.

20. A control barrier as recited in claim 19, wherein the mechanical means comprises:

(a) a locking member having an engaging slot, the locking member being hingedly mounted to the back face of the control barrier wall; and (b) an arcuate recess located along the inside edge of the support leg, wherein the locking member can be selectively rotated through the arcuate recess when the support leg is in the extended position.

21. A control barrier as recited in claim 17, wherein the back face of the control barrier wall bounds a recess complementary to the support leg, the recess being configured to receive the support leg when the support leg is in the retracted position.

* * * * *

UNITED STATES PATENT AND TRADEMARK OFFICE

CERTIFICATE OF CORRECTION

PATENT NO. : 5,993,103

DATED : Nov. 30. 1999

INVENTOR(S) : Marc E. Christensen

It is certified that error appears in the above-identified patent and that said Letters Patent are hereby corrected as shown below:

Col. 4, line 15, after "leg" change "12" to --14--

Col. 4, line 31, after "FIG." change "1" to --2--

Col. 4, line 54, after "FIG." change "42" to --44--

Col. 8, line 39, after "being" change "configure" to --configured--

Signed and Sealed this

First Day of May, 2001

*Attest:*

Nicholas P. Godici

NICHOLAS P. GODICI

*Attesting Officer*

*Acting Director of the United States Patent and Trademark Office*